US008487254B2

(12) United States Patent
Meir

(10) Patent No.: US 8,487,254 B2
(45) Date of Patent: Jul. 16, 2013

(54) NETWORK CENTRIC SYSTEM AND METHOD FOR ACTIVE THERMAL STEALTH OR DECEPTION

(75) Inventor: Ronen Meir, Ashkelon (IL)

(73) Assignee: Eltics Ltd, Ashkelon, IL (US)

( * ) Notice: Subject to any disclaimer, the term of this patent is extended or adjusted under 35 U.S.C. 154(b) by 316 days.

(21) Appl. No.: 12/856,658

(22) Filed: Aug. 15, 2010

(65) Prior Publication Data

US 2012/0205560 A1 Aug. 16, 2012

(30) Foreign Application Priority Data

Aug. 16, 2009 (IL) ..... 200417

(51) Int. Cl.
*G02F 1/01* (2006.01)

(52) U.S. Cl.
USPC ..... 250/330; 250/339.03; 250/339.04

(58) Field of Classification Search
USPC ..... 250/330, 339.03, 339.04
See application file for complete search history.

(56) References Cited

U.S. PATENT DOCUMENTS

| | | | | |
|---|---|---|---|---|
| 5,734,495 | A * | 3/1998 | Friedman | 359/350 |
| 6,338,292 | B1 * | 1/2002 | Reynolds et al. | 89/36.02 |
| 8,077,071 | B2 * | 12/2011 | Cincotti et al. | 342/3 |
| 8,080,792 | B2 * | 12/2011 | Meir | 250/330 |
| 2007/0034774 | A1 * | 2/2007 | Blake | 250/205 |
| 2011/0151575 | A1 * | 6/2011 | Fraser et al. | 436/155 |

* cited by examiner

*Primary Examiner* — Ahshik Kim
(74) *Attorney, Agent, or Firm* — Deborah Gador

(57) ABSTRACT

A system and method for active thermal stealth or deception, the system including at least two objects, each having at least one active plate and a processing module coupled to the active plate for activating the plate to provide a desired thermal signature to the object, and a remotely located central control unit for external actuation of the processing modules in each object.

13 Claims, 3 Drawing Sheets

NETWORK CENTRIC SYSTEM AND METHOD FOR ACTIVE THERMAL STEALTH OR DECEPTION

FIELD OF THE INVENTION

The present invention relates to a system and method of concealing objects from identification and recognition by thermal imaging night vision systems in general, and, in particular, to an active system and method for protecting objects from thermal imaging and from heat-seeking missiles.

BACKGROUND OF THE INVENTION

Night vision systems are used extensively for military and security purposes. These include thermal imaging cameras and ATR (automatic target recognition) systems that automatically classify targets by their thermal signature. The impact of the thermal structure of a target on seeker and sensor acquisition is well known.

Most objects have a radiated temperature either higher or lower than that of their background. Even if the radiated temperature differences are less than a degree, they can be detected. If there is no difference between the temperature of an object and its background, the object cannot be seen by a thermal imaging night vision system or by infra red based heat seeking missiles.

Today, solutions based on active countermeasures against infrared detection and tracking can be combined with passive stealth measures. These include infrared jamming (i.e., mounting of flickering infrared radiators to confuse the tracking circuits of heat-seeking missiles) and the launching of infrared decoy flares.

It is known to utilize thermal electric cooler (TEC) elements in order to provide a cover for an object which has a thermal signature different from the object, in order to hide that object or mislead the enemy. To date, these devices are operative on an individual object.

Accordingly, there is a long felt need for a system and method for providing thermal protection that could provide protection for a group of objects or military vehicles, and it would be desirable if such a system could be operated remotely.

SUMMARY OF THE INVENTION

This invention enables a large number of military objects, such as, but not limited to, tanks, APC, JLTV, trucks, small and medium military cars, and other objects having distinctive thermal signatures, to be given a thermal signature which is remotely controlled. The desired thermal signature is created by a panel or active plate formed of a plurality of Thermo-Electric Cooler (TEC) modules, whose temperature can be adjusted using a processor to provide the desired overall signature.

Control is implemented by encrypted RF communication or laser pulses or a combination thereof, so the result is network centric control by a military commander of the thermal signatures of a large number of objects at the same time. This allows a commander to create any of the following: no signature (Stealth) (i.e., the same temperature as the background behind the object); a fake signature (for deception of the enemy); or an IFF (Identify Friend or Foe) indication, by sending a radio frequency (RF) request (preferably encoded) to the controller of each of the TEC elements on the various objects. The TEC elements, in response thereto, will change the temperature of the plates coupled thereto, so as to create the requested thermal signature mark, so the objects will become substantially invisible to thermal vision, or so that the commander can easily spot a particular object by thermal imaging means and identify it from all other objects.

There is provided according to the present invention a system for active thermal stealth or deception, the system including at least two objects, each having at least one active plate and a processing module coupled to the active plate for activating the plate to provide a desired thermal signature to the object, and a remotely located central control unit for external actuation of the processing module in each object.

According to a preferred embodiment, the central control unit includes a communication module for transmitting encoded control signals to each processing module for remote actuation of the active plates.

There is also provided, in accordance with the invention, a method of providing thermal deception to at least two, and preferably a group of objects, each object including at least one active plate and a processing module coupled to the active plate for activating the plate to provide a desired thermal signature to the object, the method including coupling a remotely located central control unit to each processing module in each object for external actuation of the processing modules.

BRIEF DESCRIPTION OF THE DRAWINGS

The present invention will be further understood and appreciated from the following detailed description taken in conjunction with the drawings in which.

DETAILED DESCRIPTION OF THE INVENTION

Figure 1:
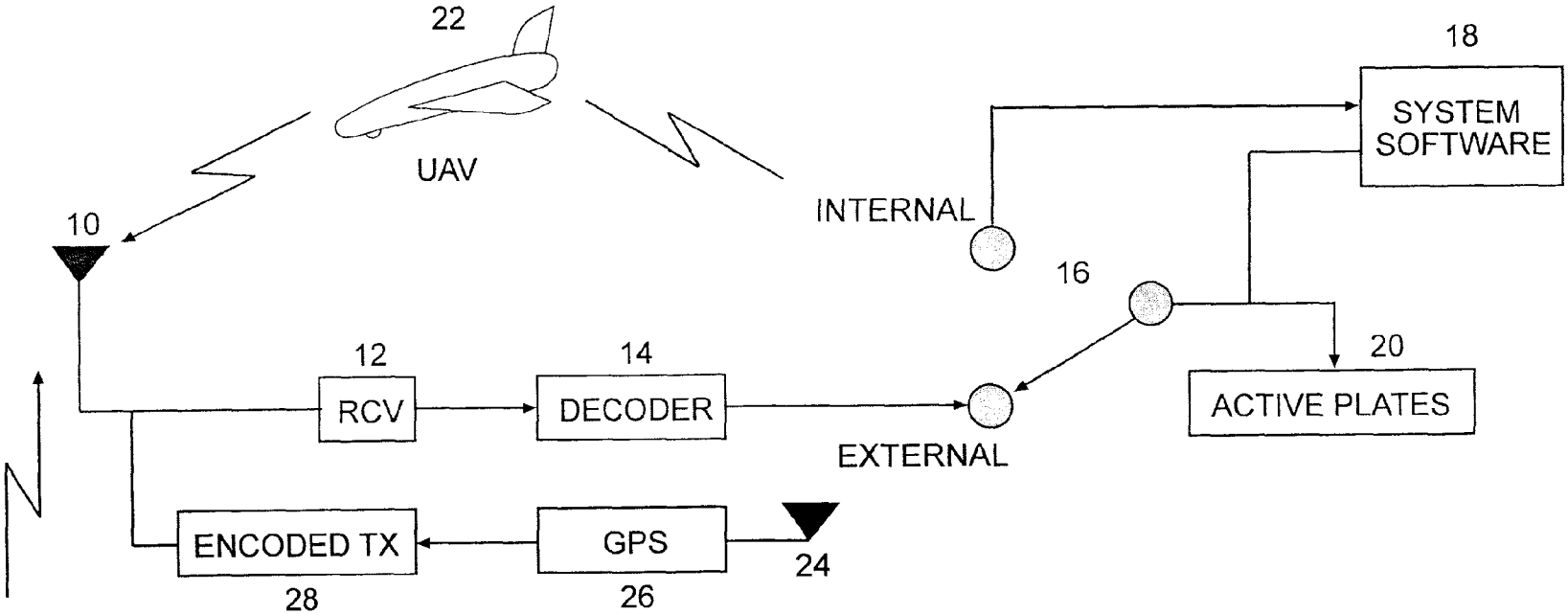
FIG. 1 is a block diagram illustration of a system for thermal stealth constructed and operative in accordance with one embodiment of the present invention.

The present invention relates to a system and method for providing remote control of the perceived thermal signatures of a plurality of objects at the same time, particularly for use by a military commander directing the objects. This is particularly useful when a commander is located remotely from the objects and has an overview of the battlefield or other area in which the objects are deployed. It will be appreciated that a commander controlling the thermal signatures can be located anywhere, i.e., on land, on sea, in the air or in space. The system includes a device and processing module for providing a selected thermal signature on each object in the group, a network centric control unit for selectively controlling each of the devices on the various objects, and a transmission module for encoding and transmitting control signals from the control unit to the processing module on each object. This transmission can be direct or can be via a satellite or a relay, for extended range.

Preferably, the device for providing a thermal signature is constructed and operative in accordance with the systems and methods described in co-pending IL patent applications nos. 177368 or 186320, to the present applicant. Such systems include a screen, made of at least one, and preferably a plurality of thermoelectric (TEC) modules, disposed between the target object and an IR detector. According to one embodiment, the screen is coupled to the target object, with a small air gap between the screen and the object. The thermoelectric modules are controlled by a microprocessor, or by an analog chip. The temperature of the screen is controlled with the use of thermal imaging sensors, preferably long, mid- and short range, which continuously measure the background temperature (usually at the opposite side of the object from the viewer or anticipated IR detector). and the micro processor is coupled to the sensors and varies the level of power to the TEC modules, based on the Peltier effect, in order to keep the surface temperature of the screen substantially equal to that of the background, even if the background is higher or lower than the ambient temperature.

If desired, the commander may use a UAV (Unmanned Aerial Vehicle) or other aircraft or rotorcraft to view the battle field with a thermal camera and provide photos and/or video to either enhance situation awareness, to verify proper implementation of stealth\deception\IFF (identification, friend or foe), or to direct the forces to desired locations, while giving every group its own specific deception signature. The command location can also direct various objects in the group to move in such a way as to provide remote collision avoidance in conditions where visibility is limited within or outside the objects. Every object can send an indication of its real location to the command location, as by encrypted transmission of GPS data (for example, the GPS data available from the active stealth system described in applicant's patents cited above), or by other means, such as secured voice communication available on board.

Referring now to FIG. 1, there is shown a block diagram illustration of a network centricsystem for thermal stealth, constructed and operative in accordance with one embodiment of the present invention. The system includes a plurality of active plates 20 (including TEC modules, which are not shown) disposed on or around the objects to be hidden. A processing module 18, including system software for activating the plates, is coupled to active plates 20 and typically is located in the object to be protected. A switch 16 is provided for selecting internal or external control of the active plates 20.

The active plate 20 can copy substantially any thermal signature desired, for example, a signature that is the same as the background behind the object (as described in detail in the above cited patent applications), and therefore the object will be invisible to thermal imaging and heat seeking missiles. Alternatively, the system can create any desired signature, including a fake signature and/or IFF marks. A database of thermal signatures may be coupled to processing module 18, from which a thermal signature can be selected, or the processing module 18 can generate an appropriate thermal signature, based on control instructions or to imitate the background. In the internal mode, the active plates 20 are controlled by software 18 and controlled from the object itself (a tank, for example). When the switch 16 is in the external mode, the active plates 20 receive signals from a remote command location, such as a UAV 22, or the system illustrated in FIG. 2 (described below), via a receiver 12 coupled to an antenna 10, or via another sensor (e.g., a laser radiation detector). These signals are decoded by the decoder 14 to provide the data or control instructions to create the desired thermal signature.

Figure 2:
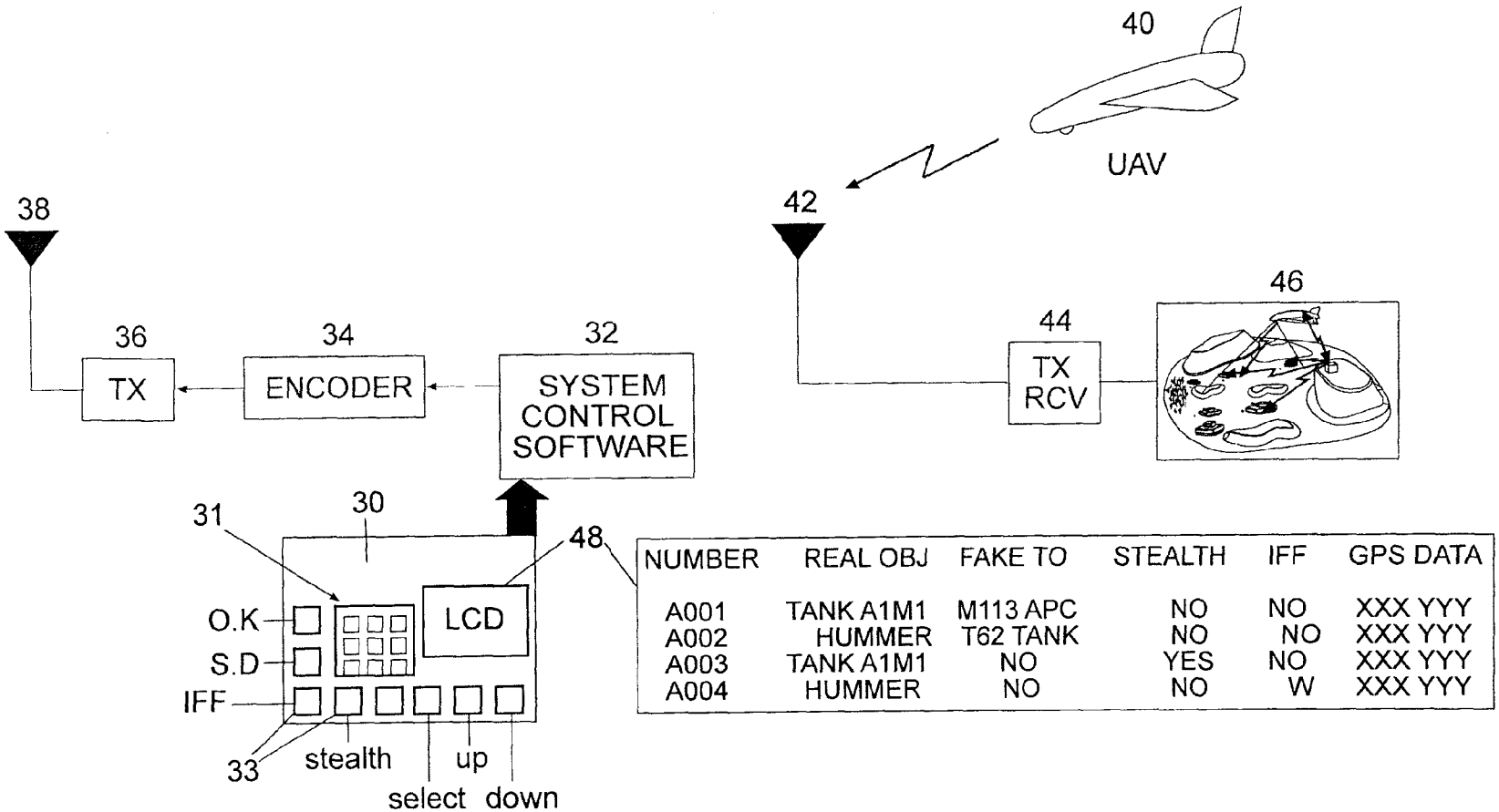
FIG. 2 is a block diagram illustration of a central management portion of a stealth system according to one embodiment of the invention.

FIG. 2 is a block diagram illustrating a remote command system, according to one embodiment of the invention, that can control a large number of objects (e.g., tanks, APCs, Hummers, missiles, etc.), each object being equipped with a system for providing a thermal signature. The remote command system includes a control unit 30, with an associated communications module (for example, an encoder 34, a transmitter 36, an antenna 38), and possibly an airborne camera 40 for observing and providing images of a battlefield to be displayed on a display 46. The control unit 30 includes a key pad 31, to enter data and codes identifying each of the objects, a plurality of switches 33, for selecting the mode of operation, and a display 48, such as an LCD display. The control unit further includes a microprocessor and software 32 connected to a database of thermal signatures stored on a chip or other memory device. The commander can allocate to every object a specific thermal signature from the data base and select and arrange the various objects for view on the display 48. The data displayed on the display 48 is then encoded by encoder 34 and transmitted by transmitter 36 and antenna 38, or via another transmitting device, such as a laser beam with encoded pulses. The data from antenna 38 in FIG. 2 is received in each object by antenna 10 in FIG. 1.

The commander can also receive video or photos from a UAV 40 or other camera-bearing vehicle, thermal imaging that is received in a receiver 44 via command antenna 42 in the object and displayed on display 46. Display 46 shows the signatures as implemented on the battlefield, including fake, invisible (stealth) and specific identification (IFF).

The thermal stealth system in each object can report its location to the commander, as by means of GPS data. See, for example, FIG. 1 where antenna 24 in the object is a GPS antenna receiving GPS signals 26 from satellites, from which it determines the location of the object, which it encodes and transmits via transmitter 10, so the commander can view its location on display 48.

If available, voice communication can be utilized by the commander to create signatures and control the large group of signatures, as by vocal notice to a human operator. This can be utilized, for example, when a database of the thermal signatures is already loaded in the processor in the object. The operator can select the signature requested by the battle commander by voice or text order, preferably utilizing encrypted communication available in the military object to be protected.

If desired, the centric system can be provided with a self-destruction option, operable by means of a switch S.D. in control unit 30. Thus, the commander can issue the self destruction command to destroy the stealth system software and hardware inside the object from a remote location. In order to verify this command before implementation, preferably the system will ask for a code entry via the key pad 31 in control unit 30 or verification will be provided in another fashion.

Figure 3:
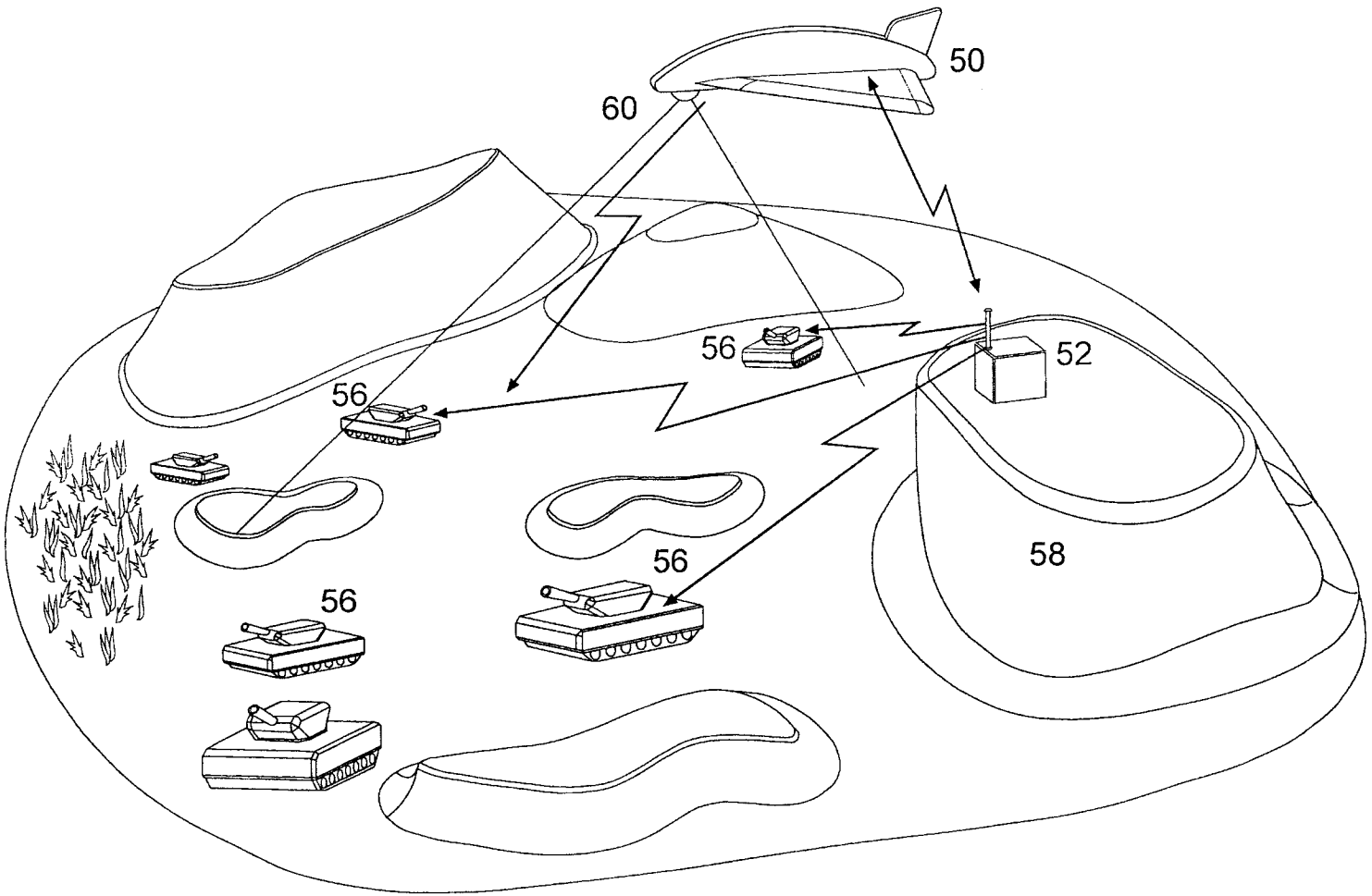
FIG. 3 is a schematic illustration of a battle field employing a system according to one embodiment of the invention.

FIG. 3 is a schematic illustration of a battle field employing a system according to one embodiment of the invention. In this illustration, the commander is located in a central location 52, here shown disposed on high ground 58. From here, he sends signals to forces 56, directly or via UAV 50 or via a satellite (not shown) or other flying vehicle. At the same time, he also receives pictures and/or video from a thermal camera 60 in UAV 50, to permit him to observe the troops with the implemented thermal signatures.

One example of use of the system of the invention is as follows. The commander located on high ground, looking down with a thermal imaging camera, sends a control signal to 40 units of military tanks, each tank having the active adaptive stealth system described above. Each tank decodes the encrypted signal and creates the thermal signature that the commander selected for it. The result can be, for example, 15 tanks that now look like APCs, while 10 look like Hummers, and 14 cannot be detected—in stealth mode. Another unit may be asked to create an IFF thermal signal, e.g., in the shape of the letter W, so that the commander will know exactly where that specific tank is located.

In addition to verifying thermal signatures and stealth performance, the commander also can alert forces to prevent possible collisions. This can be particularly important in locations or conditions where visibility is limited or when visibility within the objects is limited. In this case, the central control unit is arranged to signal the various objects and possibly provide navigation instructions so as to avoid collisions therebetween.

While the invention has been described with respect to a limited number of embodiments, it will be appreciated that many variations, modifications and other applications of the invention may be made. It will further be appreciated that the invention is not limited to what has been described hereinabove merely by way of example. Rather, the invention is limited solely by the claims which follow.

The invention claimed is:

1. A system for active thermal stealth or deception, the system comprising:

at least two objects to be protected by active thermal stealth, each said object having at least one active plate and a processing module coupled to the active plate for activating said plate to provide a desired thermal signature to said object; and a remotely located central control unit, external to the objects, for selecting a thermal signature to be implemented in each said object and for external actuation of the processing modules in each said object;

thereby providing external central control of the thermal signatures of said at least two objects.

2. The system according to claim 1, wherein said central control unit includes a communication module for transmitting encoded control signals to said processing module for remote actuation of said active plate.

3. The system according to claim 1, further comprising a database of thermal signatures, wherein said thermal signature of each object is selected independently from the group including the same temperature as a background behind the object; a fake signature selected from the database; and an IFF (Identify Friend or Foe) indication selected from the database; and wherein said processing module in each object is adapted and configured to implement a thermal signature selected for said object by said central control unit.

4. The system according to claim 2, further comprising a database of thermal signatures, wherein said thermal signature of each object is selected independently from the group including the same temperature as a background behind the object; a fake signature selected from the database; and an IFF (Identify Friend or Foe) indication selected from the database; and wherein said processing module in each object is adapted and configured to implement a thermal signature selected for said object by said central control unit.

5. The system according to claim 1, wherein said system further includes an airborne camera for providing images of said objects to said central control unit.

6. The system according to claim 1, wherein said central control unit is arranged to signal said objects so as to avoid collisions.

7. The system according to claim 2, wherein said central control unit is arranged to signal said objects so as to avoid collisions between said objects.

8. The system according to claim 1, wherein each said object further includes a switch for selecting internal or external control of said active plates.

9. The system according to claim 1, wherein each said active plate includes at least one Thermo-Electric Cooling (TEC) unit.

10. The system according to claim 3, wherein each said active plate includes at least one Thermo-Electric Cooling (TEC) unit.

11. A method of providing thermal deception to at least two objects to be protected by active thermal stealth, each said object including at least one active plate and a processing module coupled to the active plate for activating said plate to provide a desired thermal signature to said object, said method comprising:

coupling a remotely located central control unit, external to the objects, to each said processing module in each object for external actuation of said processing modules;

for each object, independently selecting, in said central control unit, a thermal signature from the croup including: the same temperature as a background behind the object; a fake signature selected from a database of thermal signatures; and an IFF (Identify Friend or Foe) indication selected from the database; and transmitting said selections to said processing modules of said at least two objects for implementation by said processing modules in each said object.

12. The method according to claim 11, further comprising providing images of said objects to said central control unit by an airborne camera.

13. The method according to claim 11, further comprising providing signals to said objects by said central control unit so as to avoid collisions between said objects.

* * * * *